US006530440B1

(12) United States Patent
Larsson et al.

(10) Patent No.: US 6,530,440 B1
(45) Date of Patent: Mar. 11, 2003

(54) PERCUSSIVE DRILLING APPARATUS

(75) Inventors: Kenneth Larsson, Sandviken (SE); Rolf Morén, Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/710,867

(22) Filed: Nov. 14, 2000

Related U.S. Application Data

(62) Division of application No. 09/299,150, filed on Apr. 26, 1999, now Pat. No. 6,164,392.

(51) Int. Cl.[7] ..... E21B 10/44
(52) U.S. Cl. ..... 175/293; 173/62
(58) Field of Search ..... 175/58, 294, 293, 175/405, 414, 418, 325.1, 325.2, 320, 321, 305, 306; 173/62, 78–80

(56) References Cited

U.S. PATENT DOCUMENTS 4,106,573 A 8/1978 Bailey
4,265,321 A 5/1981 Hibbard
4,500,224 A * 2/1985 Ewing ..... 403/343
4,625,814 A 12/1986 Helasuo et al.
4,694,911 A 9/1987 Kennedy
4,726,429 A 2/1988 Kennedy

* cited by examiner

*Primary Examiner*—Robert E. Pezzuto
(74) *Attorney, Agent, or Firm*—Burns, Doane, Swecker & Mathis, LLP

(57) ABSTRACT

A percussive drill for extension drilling includes a drill bit, a tube having a male screw thread attached to a female screw thread of the drill bit, and a rod having a male screw thread attached to a female screw thread of the tube. Central passages of the rod and tube are aligned with one another to conduct flushing fluid to the drill bit. The drill bit drills a hole whose diameter is from 60–170 mm and at least twice the outer diameter of the rod. A total area of a cross-sectional surface of the tube is within 100–125% of a total area of a cross sectional surface of the rod.

1 Claim, 2 Drawing Sheets

FIG. 4
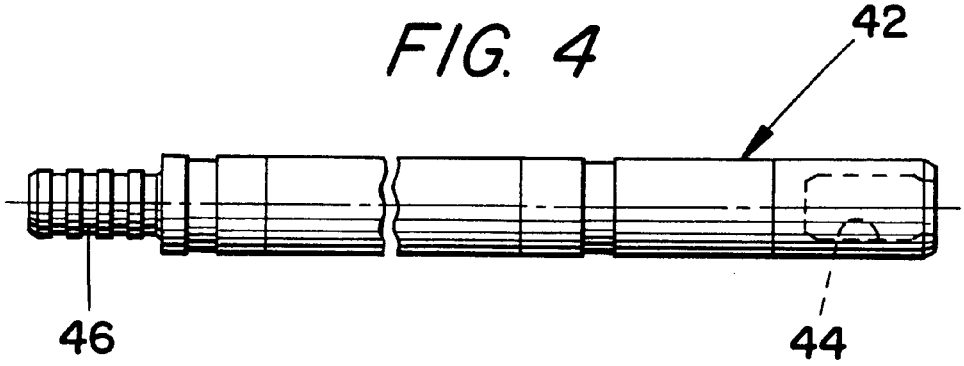
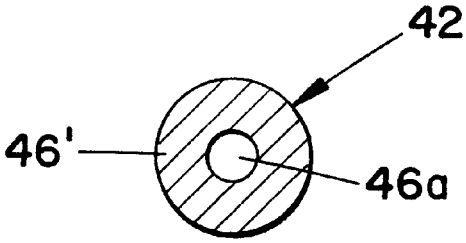
FIG. 5
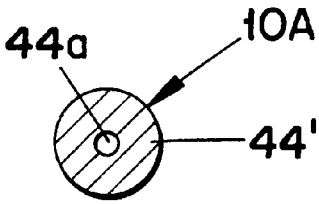
FIG. 6

PERCUSSIVE DRILLING APPARATUS

This application is a divisional of Ser. No. 09/299,150 filed Apr. 26, 1999, now U.S. Pat. No. 6,164,392.

BACKGROUND OF THE INVENTION

The present invention relates to percussive extension drilling and, in particular, to a drill string arrangement for use in such drilling.

Extension drilling typically involves the use of a drill bit mounted at the end of a drill string which is both rotated and subjected to longitudinal impacts. The upper end of the drill string is connected to an above-ground drilling machine which performs the rotation and imparts the impacts. Such a percussive drilling technique is commonly referred to as bench drilling.

The drill string includes an adapter connected to and extending from the drilling machine, and at least one rod 10 (but usually a series of rods) connecting the adapter to the drill bit. In a rod drilling apparatus 8, shown in FIG. 1, each rod 10 has a male screw thread 12 at one end and a female screw thread 14 at the other end. The uppermost rod 10' has its female thread 14 connected to a male screw thread 16 of the adapter 18. The remaining rods 10 are joined together in series. The lowermost rod 10" has its male thread attached to a female screw thread of a drill bit 20. The adapter 18 and the rods 10 have respective central passages extending therethrough and aligned with one another for conducting flushing fluid (usually air) which exits through outlets formed in a front face of the drill bit to cool the cutters and flush-away cuttings. The cuttings, along with the flushing fluid, are discharged upwardly through a gap formed between the drill string and the wall of the hole being drilled.

A problem encountered in connection with the above type of drilling apparatus involves a tendency for the rods to bend during drilling, thereby reducing the drilling speed and drilling accuracy, as well as increasing the risk of the bit becoming stuck in the ground. To deal with that problem, it has been known to interconnect the drill bit with the lowermost rod by means of a tube 20 having a larger outer diameter than the rods (see FIG. 2). The tube, being stiffer than the rods, is better able to resist bending, so that the drill bit travels faster and straighter.

Notwithstanding the success of that drilling apparatus, room for improvement remains.

It is an object of the present invention to improve the performance of the above-described drilling apparatus especially as regards the efficiency of energy transfer and the speed of flushing fluid.

SUMMARY OF THE INVENTION

The invention relates to a percussive drilling apparatus for extension drilling comprising a drill bit, a tube, and a rod. The drill bit has a rear section possessing a female screw thread. The tube includes a rear end having a female screw thread, and a front end having a male screw thread. The male screw thread is larger in diameter than the female screw thread of the tube, and is connected to the female screw thread of the drill bit. The tube has a first central fluid passage extending therethrough for conducting flushing fluid to the drill bit. The rod includes a front end having a male screw thread connected to the female screw thread of the tube. The rod has a smaller outer diameter than the tube, and includes a second central fluid passage extending therethrough for conducting flushing fluid to the first fluid passage, the second fluid passage being of smaller diameter than the first fluid passage The drill bit is sized to drill a hole having a diameter in the range of 60–170 mm which is at least twice the outer diameter of the rod. A total area of a cross-sectional surface of the tube is within 100–125% of a total area of a cross-sectional surface of the rod.

The invention also pertains to the tube per se.

BRIEF DESCRIPTION OF THE DRAWINGS

The objects and advantages of the invention will become apparent from the following detailed description of a preferred embodiment thereof in connection with the accompanying drawing in which like numerals designate like elements, and in which:

FIG. 4 is a side elevational view of a tube used in the present invention;

FIGS. 5 and 6 are cross-sectional views taken along lines II—II and XI—XI, respectively.

DETAILED DESCRIPTION OF A PREFERRED EMBODIMENT OF THE INVENTION

Figure 3:
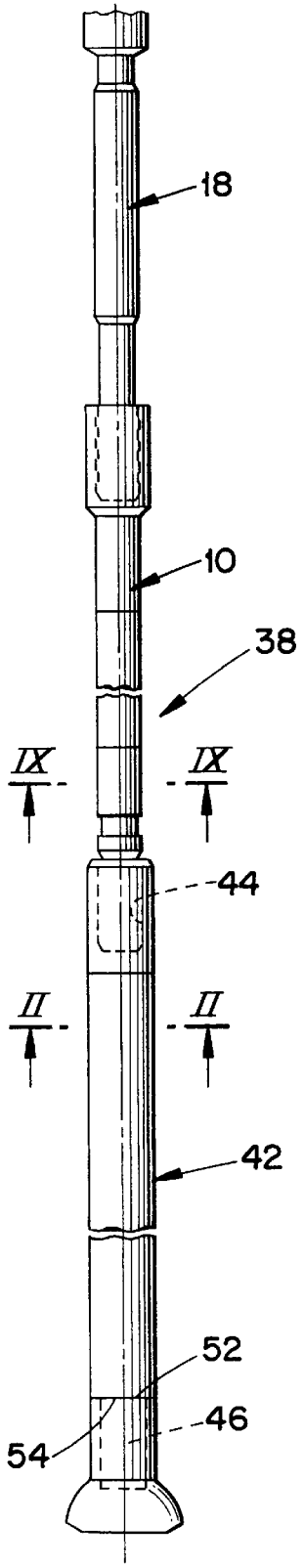
FIG. 3 is a side elevational view of a drill string according to the invention.

A percussive drilling apparatus 38 depicted in FIG. 3 includes a conventional adapter 18 whose rear (upper) end is connectible with a conventional above-ground drilling machine (not shown) which imparts rotation and longitudinal impacts to the adapter. The apparatus 38 also includes at least one conventional rod 10, and a tube 42 which is different from the afore-described conventional tube 20. In that regard, the tube 42 has different types of screw threads at its respective ends. That is, a rear end of the tube 42 connected to the lowermost rod 10, has a female screw thread 44 which is smaller than a male screw thread 46 disposed at the other (front) end of the tube that is connected to a drill bit 48. The female screw thread 44 corresponds in size to the male screw thread of the rod 10, whereas the male screw thread 46 is of larger diameter and connects to a correspondingly sized female screw thread of the drill bit.

The rod 10 and the tube 42 have respective central passages 44, 46 therein for conducting flushing fluid (preferably air) to the drill bit (see FIGS. 5 and 6). Each of the tube and rod includes a cross sectional surface between their inner and outer diameters. A total area of the cross-sectional surface 46' of the tube 42 (shown as cross-hatched in FIG. 5) is within 100–125% of the total area of the cross-sectional surface 44' of the rod, whereby an efficient transfer of energy (i.e., percussive forces) takes place during drilling. The tube outer diameter will always be so much larger than the rod outer diameter, that the diameter of the passage 46 must be larger than that of the passage 44 in order for the area of the cross sectional surface 46' of the tube to be in the range of 100 to 125% of the area of the cross sectional surface 44' of the rod. Preferably, the area of the cross sectional surface 46' is not less than 108 of the cross sectional surface 44'.

The drill bit 48 is sized to drill a hole having a diameter in the range of 60–170 mm, which diameter is at least two times an outer diameter of the rod 10. The drill bit 48 has a cylindrical outer peripheral surface 50 encompassing the rear, female-threaded section of the drill bit. That surface 50 has a diameter substantially the same as the outer surface of the tube 42, and the outer surface of the tube adjoins the surface 50, to provide a continuous, smooth surface structure for guiding the upwardly traveling flushing fluid. This produces faster upward travel of the flushing fluid by minimizing cavitation in the flow of flushing fluid. Also, there occurs abutment between the rear (upper) annular shoulder surface 52 of the drill bit and the front (lower) annular end surface 54 of the tube 42 to achieve good energy transfer (i.e., less shock wave reflexes).

Figure 1:
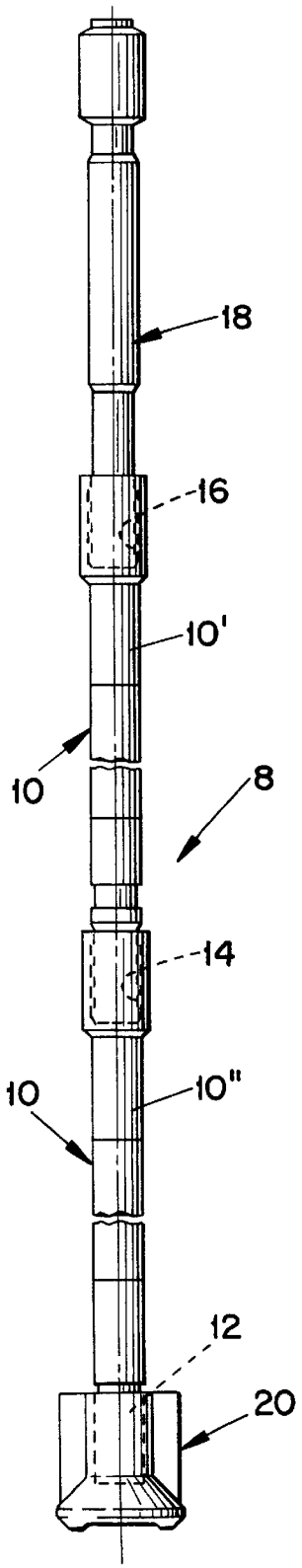
FIG. 1 (PRIOR ART)
FIG. 1 is a side elevational view of a first type of conventional drill string.
Figure 2:
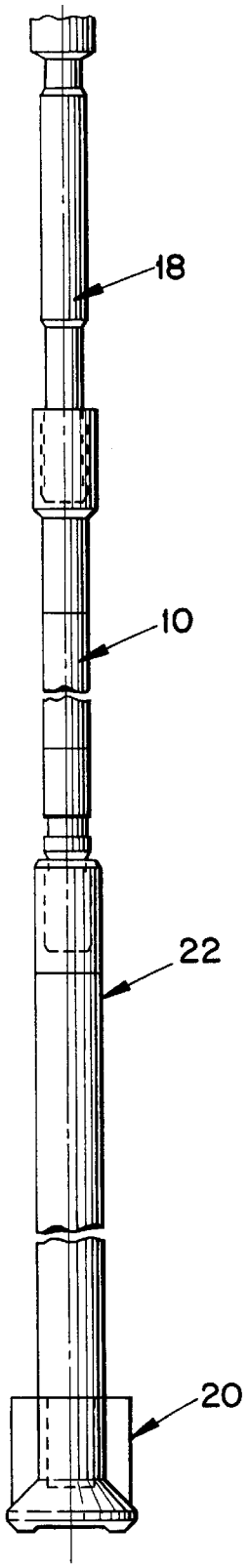
FIG. 2 (PRIOR ART)
FIG. 2 is a side elevational view of a second type of conventional drill string.

The present invention provides an improved performance in the type of drilling apparatus which combines a rod and a tube. That is, by making the area of the cross-sectional tube surface 46' lie within 100–125% of the cross sectional rod surface 44', a higher percentage of the percussive energy will be transmitted from the rod to the tube than in the case of the prior art of FIG. 2 wherein the area of the cross-sectional surface of the tube typically exceeds the area of the cross-sectional surface of the rod by 150–170%.

Furthermore, by making the size of the tube's male thread 46 larger than that of the tube's female thread 44, the thread wear life and breakage resistance is increased.

The provision of a drill bit having a rear section whose outer diameter is substantially the same as that of the adjoining surface of the tube promotes a faster upward flow of flushing fluid and achieves better energy transfer, due to axial abutment between the lower end of the tube and the upper end of the drill bit.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A drilling tube for a percussive drilling apparatus, the tube including a rear end defining an upper end of the drilling tube and having a female screw thread, and a front end defining a lower end of the drilling tube and having a male screw thread, the male screw thread being larger in diameter than the female screw thread, the tube having a central fluid passage extending therethrough for conducting flushing fluid.

* * * * *